US008299002B2

(12) United States Patent
Glasgow et al.

(10) Patent No.: US 8,299,002 B2
(45) Date of Patent: Oct. 30, 2012

(54) ADDITIVE COMPOSITION

(75) Inventors: Michael B. Glasgow, Williamsburg, VA (US); Samuel H. Tersigni, Glen Allen, VA (US); Anthony Joseph Rollin, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 224 days.

(21) Appl. No.: 11/253,227

(22) Filed: Oct. 18, 2005

(65) Prior Publication Data

US 2007/0087947 A1 Apr. 19, 2007

(51) Int. Cl.
*C10M 129/95* (2006.01)
*C10M 135/08* (2006.01)

(52) U.S. Cl. ..... 508/388; 508/459

(58) Field of Classification Search ..... 508/465, 508/469, 485, 568, 591, 388, 459; 208/18
See application file for complete search history.

(56) References Cited

U.S. PATENT DOCUMENTS

| | | | | |
|---|---|---|---|---|
| 2,393,925 | A | 1/1946 | Morris et al. | |
| 3,173,870 | A | 3/1965 | Fields et al. | |
| 3,974,081 | A | 8/1976 | Rutkowski et al. | |
| 4,029,587 | A * | 6/1977 | Koch | 508/303 |
| 4,029,588 | A | 6/1977 | Koch | |
| 4,116,877 | A | 9/1978 | Outten et al. | |
| 5,578,236 | A | 11/1996 | Srinivasan et al. | |
| 5,891,786 | A * | 4/1999 | Srinivasan et al. | 508/188 |
| 6,627,584 | B2 * | 9/2003 | Ozbalik | 508/192 |
| 2003/0119682 | A1 | 6/2003 | Saini et al. | |
| 2004/0092409 | A1 | 5/2004 | Liesen | |
| 2004/0154958 | A1 * | 8/2004 | Alexander et al. | 208/18 |
| 2005/0059563 | A1 | 3/2005 | Sullivan et al. | |
| 2005/0137097 | A1 | 6/2005 | George et al. | |

FOREIGN PATENT DOCUMENTS

| | | | |
|---|---|---|---|
| JP | 8-209174 | A | 8/1996 |
| WO | WO 99/02628 | | 1/1999 |
| WO | WO 01/79399 | | 10/2001 |
| WO | 2005/026299 | A2 | 3/2005 |
| WO | 2005/035700 | A1 | 4/2005 |
| WO | 2005/090530 | A1 | 9/2005 |

OTHER PUBLICATIONS

Japanese Search Report, Japan Patent Office, Japanese Patent Application No. 284110/06, Aug. 25, 2009.

* cited by examiner

*Primary Examiner* — James Goloboy
*Assistant Examiner* — Taiwo Oladapo
(74) *Attorney, Agent, or Firm* — Luedeka Neely Group, P.C.

(57) ABSTRACT

An additive composition including at least one dispersant viscosity index improver and at least two seal swell additives is disclosed.

11 Claims, No Drawings

ADDITIVE COMPOSITION

DESCRIPTION OF THE DISCLOSURE

1. Field of the Disclosure

The present invention relates to an additive composition comprising at least one dispersant viscosity index improver and at least two seal swell additives.

2. Background of the Disclosure

Seal swelling agents are known and have been used to lubricate an engine and recondition the seals of new and/or high mileage engines. In particular, seal performance tends to deteriorate with use and aging. The seals tend to harden or shrink to the point where leakage of the fluid composition, such as an automatic transmission fluid, past the seal material has occurred. The leakage can lead to defective operation or failure to operate at all.

Current compositions used to recondition seals are generally fully additized lubricant blends comprising a seal swell additive such as a sulfone or ester and part or all of a suitable additive package. Compositions used to recondition seals comprised of sulfone and ester seal swell additives alone, however, undergo phase separation at ambient temperature in these compositions.

SUMMARY OF THE DISCLOSURE

In accordance with the disclosure, there is disclosed an additive composition comprising at least one dispersant viscosity index improver and at least two seal swell additives.

In another embodiment, there is disclosed a top treat composition suitable for addition to a lubricant composition comprising at least one dispersant viscosity index improver and at least two seal swell additives.

In another embodiment, there is disclosed a lubricant composition comprising a minor amount of at least one additive composition, wherein the additive composition consists essentially of at least one dispersant viscosity index improver and at least two seal swell additives.

In another embodiment, there is disclosed a method for improving the miscibility of a lubricating composition comprising combining at least one dispersant viscosity index improver and at least two seal swell additives, wherein one of the seal swell additives is a diester and the other of the seal swell additives is a sulfone.

In another embodiment, there is disclosed a method for improving the miscibility of a lubricating composition comprising adding at least one dispersant viscosity index improver to at least two seal swell additives.

In another embodiment, there is disclosed a method for increasing a volume of a seal comprising adding to a lubrication system an additive package comprising at least one dispersant viscosity index improver and at least two seal swell additives.

Additional objects and advantages of the disclosure will be set forth in part in the description which follows, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure relates to an additive composition comprising at least one dispersant viscosity index improver and at least two seal swell additives.

The at least one dispersant viscosity index improver ("VII") can be an olefin copolymer VII, polyalkyl (meth) acrylate VII, styrene-maleic ester VII, hydrogenated styrene isoprene polymer VII, and mixtures of the foregoing products. Also suitable for use herein can be at least one dispersant/antioxidant VII. The at least one dispersant viscosity index improver can be supplied in the form of a solution in an inert solvent, typically a mineral oil solvent, which usually is a severely refined mineral oil. The viscosity index improver solution as received often can have a boiling point above 200° C. and a specific gravity of less than 1 at 25° C. In addition, it can have sufficient shear stability such that the finished fluid composition possesses a viscosity of at least 5.0 cSt at 100° C. after 40 cycles in the FISST (Fuel Injector Shear Stability Test) of ASTM D-5275.

Non-limiting examples of viscosity index improvers include polyisobutenes, polymethacrylate acid esters, polyacrylate acid esters, diene polymers, polyalkyl styrenes, alkenyl aryl conjugated diene copolymers, polyolefins, and multifunctional viscosity improvers.

In an embodiment, the at least one dispersant viscosity index improver can be provided as a hydrocarbon solution having a polymer content in the range from about 20 to about 95 wt. %, and for example from about 50 to about 95 wt. %, and a nitrogen content in the range from about 0 to about 0.5 wt. %, and for example from about 0.15 to about 0.25 wt %. A finished fluid comprising the at least one dispersant viscosity index improver, for example, can exhibit a permanent shear stability index (a PSSI value) using ASTM test method D-3945a of no higher than about 45, for example 30 or less, and as a further example 15 or less.

In an embodiment, the at least one dispersant viscosity index improver can be a functionalized olefin copolymer. The polymer or copolymer substrate can be prepared from ethylene and propylene or it can be prepared from ethylene and at least one higher olefin within the range of $C_3$ to $C_{23}$ alpha-olefins.

Non-limiting examples of polymers for use herein include copolymers of ethylene and at least one $C_3$ to $C_{23}$ alpha-olefins. In an embodiment, copolymers of ethylene and propylene can be used. Other alpha-olefins suitable in place of propylene to form the copolymer or to be used in combination with ethylene and propylene to form a terpolymer include 1-butene, 2-butene, isobutene, 1-pentene, 1-hexene, 1-octene and styrene; $\alpha,\omega$-diolefins such as 1,5-hexadiene, 1,6-heptadiene, 1,7-octadiene; branched chain alpha-olefins such as 4-methylbutene-1,5-methylpentene-1, and 6-methylheptene-1; and mixtures thereof.

The additive composition can comprise up to 75 wt. percent of the dispersant viscosity index improver, for example from about 1 to about 60 wt. percent, and as a further example from about 10 to about 50 wt. percent.

In an embodiment, the additive composition can be added to a lubrication system comprising a lubricating composition. On an active ingredient basis (i.e., excluding the weight of inert diluent or solvent associated with the viscosity index improver as supplied), the lubricant composition can comprise from about 0.5 to about 10 wt. %, for example from about 1 to about 10 wt. %, and as a further example from about 5 to about 8 wt. % of the dispersant viscosity index improver. Small departures from this range can be resorted to as necessary or desirable in any given situation.

The additive composition can also comprise at least two seal swell additives. It is understood that any compound that swells a seal is included within the scope of the disclosure. The at least two seal swell additives can provide good seal conditioning for many varieties of seal materials, such as elastomers. In an embodiment, the compositions disclosed herein can swell polyacrylate, acrylic (VAMAC®), nitrile, and fluoroelastomer (VITON®) seals, which can be found in the GM DEXRON® specification for automatic transmission fluids. The type of elastomer seal material is not limited to the above types, but could include in an embodiment silicone, acrylic, ethylene acrylic, chlorosulfonated polyethylene or hydrogenated nitriles which can be conditioned with the additive composition.

The at least two seal swell additives for use in the compositions of this disclosure can be selected from oil-soluble esters, oil-soluble sulfones, and mixtures thereof. The ester based seal swell additive can include esters of monobasic and dibasic acids with monoalcohols, or esters of polyols with monobasic esters. Generally speaking, suitable esters, such as diesters, include the adipates, azelates, and sebacates of $C_8$-$C_{13}$ alkanols (or mixtures thereof, and the phthalates of $C_4$-$C_{13}$ alkanols (or mixtures thereof. Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid. The seal swell additive can be chosen from an aryl ester, alkyl ester, and a vegetable based ester.

In an aspect, the at least two seal swell additives can be, for example, the oil-soluble dialkyl esters of (i) adipic acid, (ii) sebacic acid, or (iii) phthalic acid. The adipates and sebacates can be used in an amount ranging from about 0.5 to about 15 wt % in the lubricating composition. In the case of the phthalates, the levels in the lubricating composition can fall in the range from about 0.5 to about 10 wt %. Generally speaking, the higher the molecular weight of the adipate, sebacate or phthalate, the higher should be the treat rate within the foregoing ranges.

Suitable sulfone seal swell agents are described in U.S. Pat. Nos. 3,974,081; 4,029,587; 4,029,588; and 4,116,877, the disclosures of which are incorporated by reference in their entirety. Additional non-limiting examples of the at least two seal swelling additives are sulfolanes, sulfolane derivatives, phenates, phthalate plasticizers like phthalate plasticizers, more particularly dioctyl phthalate, dinonly phthalate or dihexylpthalate, or other plasticizers. Other seal swelling compositions including 3-alkoxysulfolane or the like, in which the alkoxy group can contain at least from about 4 to about 25 carbon atoms.

More particularly, seal swelling additives suitable for use herein include 3-isodecoxysulfolane, and other substituted sulfolanes including those having: 1) a hydrocarbon-based radical having at least about 4 carbon atoms such as aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like. Examples include butyl, pentyl, hexyl, octyl, decyl, dodecyl, eicosyl, decenyl, cyclohexyl, phenyl, tolyl, heptylphenyl, isopropenylphenyl, and naphthyl; 2) substituted hydrocarbon radicals containing non-hydrocarbon substituents, which do not alter the predominantly hydrocarbon character of the radical such as halo, nitro, and cyano compounds; and 3) hetero radicals which are hydrocarbons which contain atoms other than carbon present in a chain or ring otherwise composed of carbon atoms such as oxygen, nitrogen, and sulfur.

Other suitable substituted sulfolanes can be those in which a hydrocarbon radical is selected free from acetylenic unsaturation and which can contain about 4 to about 100 carbon atoms. Non-limiting examples (all isomers being included) can be butyl, amyl, hexyl, octyl, decyl, dodecyl, eicosyl, triacontanyl, butenyl, dodecenyl, phenyl, naphthyl, tolyl, dodecylphenyl, tetrapropene-alkylated phenyl, phenethyl, cyclohexyl, and methylcyclohexyl. Each of the substituted hydrocarbon radicals and hetero radicals can be hydrogen or a lower alkyl-based (and usually a lower alkyl) radical, the word "lower" denoting radicals containing up to 7 carbon atoms. Non-limiting examples of lower alkyl radicals (all isomers being included, such as the straight chain radicals) can be methyl, ethyl, propyl, butyl, and hexyl.

The above-described substituted sulfolanes can comprise a class of compounds which can be prepared by the reaction of 3-sulfolene or a substituted derivative thereof with an organic hydroxy compound, ordinarily an alcohol. This method for their preparation is described, for example, in U.S. Pat. No. 2,393,925, and in Data Sheet DS-58:3 of Shell Development Company entitled "3-Sulfolene". The 3-sulfolenes can be prepared by reaction of sulfur dioxide with a conjugated diene such as butadiene or isoprene.

Moreover, aliphatic alcohols of 8 to 13 carbon atoms, e.g., tridecyl alcohol in combination with an oil-soluble, saturated hydrocarbyl ester of 10 to 60 carbon atoms and 2 to 3 ester linkages, e.g., dihexyl phthalate can be useful.

Alcohol-type seal swell additives can be linear alkyl alcohols of low volatility. Non-limiting examples of suitable alcohols can be decyl alcohol, tridecyl alcohol and tetradecyl alcohol. Mineral oils useful as seal swell additives can be typically low viscosity mineral oils with high naphthenic or aromatic content. Non-limiting examples of suitable mineral oils can be Exxon Necton-37 (FN 1380) and Exxon Mineral Seal Oil (FN 3200).

In an aspect, the at least two seal swell additives can be different. In an embodiment, one of the at least two seal swell additives can be a diester and another of the at least two seal swell additives can be a sulfone.

The at least two seal swell additives can be present in the additive composition in an amount ranging from about 1% to about 75%, for example from about 1% to about 60%, and as a further example about 10% to about 50% by weight relative to the total weight of the additive composition. However, the at least two seal swell additives can be present in any desired or effective amount so long as they provide seal swell properties to the seal materials. The at least two seal swell additives can be present in any ratio. In an aspect, the ratio of a first seal swell additive to a second seal swell additive can range from about 1:99 to about 99:1, including any and all subranges in between.

The additive composition can have a kinematic viscosity ranging from about 2 to about 50 cSt at 100° C., for example from about 2 to about 20 cSt, and as a further example from about 4 to about 10 cSt. Kinematic viscosity was measured by recording the time for a fixed volume of fluid to flow under gravity through the capillary of a calibrated viscometer tube under a reproducible driving head and at a closely controlled and known temperature. The kinematic viscosity is the product of the measured flow time and the calibration constant of the viscometer tube. The method employed conforms to ASTM D-445-03 (Standard Test Method for Kinematic Viscosity of Transparent and Opaque Liquids).

The disclosed additive composition can be added to a lubricating composition. In an aspect, the lubricating composition can comprise a minor amount of the additive composition and a major amount of a base oil. A "minor amount" is understood to mean less than 50% by weight relative to the total weight of the lubricating composition. A "major amount" is understood to mean greater than or equal to 50% by weight relative to the total weight of the lubricating composition.

The disclosed additive composition may be added to a lubricating composition as a top treat. A top treat, as used herein, is a fluid composition that may be added to a partially or a fully formulated (finished) lubricating fluid. A top treat may be added at any time. For example, a top treat may be added by the manufacturer, e.g., as a factory fill; by the end user, e.g., as a service fill; or by any other party desiring to impart the properties of the top treat to a fluid.

The base oil can be selected from, for example, natural oils such as mineral oils, vegetable oils, paraffinic oils, naphthenic oils, aromatic oils, synthetic oils, derivatives thereof, and mixtures thereof. The synthetic oils can comprise at least one of an oligomer of an alpha-olefin, an ester, an oil derived from a Fischer-Tropsch process, and a gas-to-liquid stock.

These lubricating compositions can be effective in a variety of applications including crankcase lubricating oils for spark-ignited and compression-ignited internal combustion engines, two-cycle engines, aviation piston engines, marine and low-load diesel engines, and the like. The additive composition can find use in a wide variety of lubricants, including motor oils, greases, sucker-rod lubricants, cutting fluids, and even spray-tube lubricants. It is also contemplated that the formulation may be applicable to automatic transmission fluids, transaxle lubricants, gear lubricants, hydraulic fluids, and other lubricating oil compositions which can benefit from the incorporation of the disclosed compositions. For example, the lubricating composition can include fluids suitable for any power transmitting application, such as a step automatic transmission or a manual transmission. Further, the lubricating composition can be suitable for use in at least one transmission with a slipping torque converter, a lock-up torque converter, a starting clutch, and at least one shifting clutch. Such transmissions can include four-, five-, six-, and seven-speed transmissions, and continuously variable transmissions (chain, belt, or disk type). They can also be used in automated manual and dual-clutch transmissions.

The composition can also include other additives such as dispersants, non-dispersant viscosity index improvers, over-based detergents, antioxidants, detergents, magnesium oxide, calcium carbonate, extreme pressure (EP) agents, wear reduction agents, anti-foaming agents, friction modifying agents, anti-misting agents, cloud-point depressants, pour-point depressants, mineral and/or synthetic oils mixtures thereof and combinations thereof. These additives can be used alone or in combination, such as in an optional additional additive package.

Lubricant compositions, such as modern motor oils, can be made by combining a pre-formed additive package with a refined or synthetic base oil stock. A lubricant composition can comprise various different lubricant additive packages. Because lubricant additives can be easier to handle and measure in liquid form those additives which are normally solid can be dissolved in small amounts of base oil stock.

It is believed, without being limited to any particular theory, that the at least one dispersant viscosity index can improve miscibility of the components in the composition and/or can provide viscosity lift and/or can stabilize the composition. In an aspect, the additive composition can be stable over a range of temperatures, such as from about 2° C. to about 55° C., for example from about 4° C. to about 50° C., and as a further example about 23° C.

In some aspects, the disclosed additive composition can be added to a vehicle, for example to the transmission, wherein the composition would swell the seals and thereby improve the performance of the engine by reducing the amount of transmission fluid leaking through the seals. Moreover, the additive composition can have increased stability as compared to compositions that did not comprise at least one dispersant viscosity index improver and at least two seal swell additives.

In additional aspects, there is disclosed a method for improving the miscibility of a lubricating composition comprising combining at least one dispersant viscosity index improver and at least two seal swell additives. Moreover, there is also disclosed a method for increasing a volume of a seal comprising adding to a lubrication system the disclosed additive composition. In further aspects, an automatic transmission fluid composition can comprise an oil of lubricating viscosity, such as those described above, and the disclosed additive composition.

EXAMPLES

As an example, to produce the disclosed additive composition in Table 1, about 15% by weight dispersant polymethacrylate viscosity index improver was added to about 85% by weight sulfone and diester seal swell additives to produce a mixture. The mixture was mechanically stirred at approximately 65° C. for about 1 hour, then allowed to cool to ambient temperature. There was no evidence of haziness or sedimentation following storage of the additive composition at 4° C., ambient, or 50° C. for eight weeks. Results are in Table 2.

To measure the seal swell characteristics of the additive composition in a lubricating system, the additive composition was mixed into a lubrication system (example: a fully formulated commercial ATF) at approximately 65° C. for 1 hour. The mixture was tested according to the DEXRON® Elastomer seal test methods for the DEXRON® seals found in Appendix B of the DEXRON®-III "H" specification, GMN 10055 release date October 2003. The method measures volume change, i.e. swell, and hardness change of the Elastomer seal materials after physical contact with the lubricating composition under conditions specified in the method. Comparison of the results vs. a reference sample of the base lubricating system is found in Table 1.

TABLE 1

| | | Control additive package | Inventive additive package | Lubricating comp. only % Vol. change/ % Hardness | Lubricating comp. w/control % Vol. change/ % Hardness | Lubricating comp. only % Vol. change/ % Hardness | Lubricating comp. w/inventive % Vol. change/ % Hardness | Specification (% Vol. change/ % Hardness) |
|---|---|---|---|---|---|---|---|---|
| DEXRON ® | V1 | | | 12.37/−6 | 14.46/−8 | 12.27/−6 | 15.01/−7 | +7 to +20/−15 to −2 |
| Seal | V2 | | | 2.91/0 | 4.37/−1 | 6.34/−2 | 9.77/−4 | +2 to +12/−7 to +3 |
| Materials | V3 | | | 10.51/−6 | 12.70/−6 | 12.51/−6 | 15.72/−9 | +7 to +22/−14 to −2 |
| | P1 | | | 3.81/−2 | 5.36/−5 | 4.04/−2 | 6.08/−4 | 0.00 to +8/−10 to 0 |
| | P2 | | | 2.98/−2 | 4.20/−3 | 4.27/−2 | 6.06/−5 | 0.00 to +8/−11 to +3 |
| | P3 | | | 0.41/0 | 1.78/−1 | −0.09/0 | 1.77/−2 | 0.00 to +4/−8 to +4 |
| | F1 | | | 1.42/0 | 2.12/0 | 1.20/0 | 2.29/1 | 0.00 to +4/−5 to +4 |
| | F2 | | | 1.70/0 | 2.38/0 | 1.49/1 | 2.46/0 | 0.00 to +4/−2 to +5 |
| | N1 | | | 0.45/2 | 2.15/−3 | −1.44/6 | 0.19/4 | 0.00 to +5/−12 to +12 |
| | N2 | | | 1.91/3 | 3.75/−1 | 2.50/3 | 5.42/0 | 0.00 to +6/−9 to +5 |

TABLE 1-continued

| | | Control additive package | Inventive additive package | Lubricating comp. only % Vol. change/ % Hardness | Lubricating comp. w/control % Vol. change/ % Hardness | Lubricating comp. only % Vol. change/ % Hardness | Lubricating comp. w/inventive % Vol. change/ % Hardness | Specification (% Vol. change/ % Hardness) |
|---|---|---|---|---|---|---|---|---|
| KV 100° C. | cSt | 8.43 | 6.06 | | 7.65 | | 7.51 | |
| KV 40° C. | cSt | 67.21 | 22.58 | | 33.78 | | 32.33 | |
| VI | | 94 | 239 | | 206 | | 212 | |
| BV −40° C. | cP | 797,000 | 3,310 | | 9,590 | | 8,360 | |

The first number in the columns represents the volume % amount that the seal changed, i.e. a high positive number indicates that positive volume change (swell) has been imparted to the seal material. For example, the data for Seal V3, shows that a lubricating composition without an additive package had a % volume change of 10.51 and 12.51. When a control additive package (which does not contain at least one dispersant viscosity index improver) was added, then the % volume change of the seal was 12.70. When the inventive additive package was added, the % volume change of the seal was 15.72.

The second number in the columns represents the change in hardness as determined using GM DEXRON®-III "H" specification GMN10055, or DEXRON®-VI specification GMN10060, or Ford MERCON® specification, i.e., a high negative number indicates an increase in the suppleness of the seal material. Reviewing the data for Seal V3 again, the data shows that a lubricating composition without an additive package had a % hardness change of −6 and −6. This number did not change when a control additive package was added. However, when the inventive additive package was added, the % hardness change of the seal was −9.

As can be seen from the data in Table 1, the lubricating composition comprising the inventive additive package exhibited increased swell and became softer (i.e., had a high negative number). Moreover, the data indicates that the majority of the seals tested exhibited improved results with the inventive additive package as compared to the control additive package.

The additive composition was poured into 50-ml scintillation vials and stored in cold, ambient, and hot conditions for three months storage stability testing. Stability of lubricating compositions is important to ensure a homogeneous composition Under a wide temperature range of conditions of use. Referring to the data shown in Table 2, the blend observations for the additive composition were rated using a scale From 1 to 10. An observation of any haze, flocculent (suspended solids), or sediment (settled solids), i.e. a rating of less than 10, would indicate incompatibility of the additive composition. The additive composition of the invention was observed to remain clear and bright after 84 days of storage at 4° C., ambient temperature, and 50° C.

TABLE 2

| Blend Observations | | | | | |
|---|---|---|---|---|---|
| | | Inventive Additive | Additive Composition w/o dispersant VII | | |
| Storage Temperature | Day | composition Rating | Rating | Rating | Description of Observation |
| 4° C. | 1 | 10 | 1 | 1 | Phase separation |
| | 8 | 10 | 1 | 2 | Heavy sediment |
| | 14 | 10 | 1 | 3 | Light sediment |
| | 21 | 10 | 1 | 4 | Heavy flocculant |
| | 28 | 10 | 1 | 5 | Light flocculant |
| | 56 | 10 | 1 | 6 | Trace flocculant |
| | 84 | 10 | 1 | 7 | Cloudy |

TABLE 2-continued

| Blend Observations | | | | | |
|---|---|---|---|---|---|
| | | Inventive Additive | Additive Composition w/o dispersant VII | | |
| Storage Temperature | Day | composition Rating | Rating | Rating | Description of Observation |
| 24° C. (Ambient) | 1 | 10 | 1 | 8 | Hazy |
| | 8 | 10 | 1 | 9 | Trace of haze |
| | 14 | 10 | 1 | 10 | Clear fluid |
| | 21 | 10 | 1 | | |
| | 28 | 10 | 1 | | |
| | 56 | 10 | 1 | | |
| | 84 | 10 | 1 | | |
| 50° C. | 1 | 10 | 1 | | |
| | 8 | 10 | 1 | | |
| | 14 | 10 | 1 | | |
| | 21 | 10 | 1 | | |
| | 28 | 10 | 1 | | |
| | 56 | 10 | 1 | | |
| | 84 | 10 | 1 | | |

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An additive composition consisting essentially of at least one dispersant viscosity index improver and at least two seal swell additives, wherein one of the at least two seal swell additives is diisooctyl adipate and another of the at least two seal swell additives is an oil soluble sulfone, and further wherein the additive composition is a top treat transmission fluid additive.

2. The composition of claim 1, wherein the at least one dispersant viscosity index improver is chosen from polymethacrylates, olefin copolymers, and hydrogenated styrene isoprene polymers.

3. The composition of claim 1, wherein the at least one dispersant viscosity index improver is present in an amount ranging from about 1% to about 75% by weight relative to the total weight of the additive composition.

4. The composition of claim 1, wherein the at least one dispersant viscosity index improver is present in an amount ranging from about 10% to about 50% by weight relative to the total weight of the additive composition.

5. The composition of claim 1, wherein the at least one dispersant viscosity index improver is a polymethacrylate.

6. The composition of claim 1, wherein the oil-soluble sulfone is a substituted sulfolane comprising at least one of:

a) a hydrocarbon-based radical comprising at least 4 carbon atoms;

b) a substituted hydrocarbon radical comprising non-hydrocarbon substituents; and c) hetero radicals.

7. The composition of claim 1, wherein the composition has a kinematic viscosity ranging from about 2 to about 50 cSt at 100° C.

8. The composition of claim 7, wherein the composition has a kinematic viscosity ranging from about 2 to about 20 cSt at 100° C.

9. The composition of claim 1, wherein the composition exhibits stability over a range of temperatures.

10. The composition of claim 9, wherein the composition exhibits stability from about 4° C. to about 50° C.

11. A method for increasing a volume of a seal comprising adding to a transmission system a top treat additive package consisting essentially of at least one dispersant viscosity index improver and at least two seal swell additives, wherein one of the at least two seal swell additives is diisooctyl adipate and another of the at least two seal swell additives is an oil soluble sulfone.

* * * * *